US008237037B1

(12) United States Patent
Plummer

(10) Patent No.: US 8,237,037 B1
(45) Date of Patent: Aug. 7, 2012

(54) ELECTRIC SPOON

(76) Inventor: Larry L. Plummer, Walkerton, IN (US)

( * ) Notice: Subject to any disclaimer, the term of this patent is extended or adjusted under 35 U.S.C. 154(b) by 0 days.

(21) Appl. No.: 12/945,276

(22) Filed: Nov. 12, 2010

Related U.S. Application Data

(60) Provisional application No. 61/267,958, filed on Dec. 9, 2009.

(51) Int. Cl.
*G10D 13/08* (2006.01)

(52) U.S. Cl. ..... 84/402

(58) Field of Classification Search ..... 446/265; 84/402–410, 422, 4
See application file for complete search history.

(56) References Cited

U.S. PATENT DOCUMENTS 2,616,218 A * 11/1952 Brown ..... 446/418
5,075,970 A * 12/1991 Albert ..... 30/123
5,811,709 A 9/1998 Adinolfi
6,982,376 B2 1/2006 Wise

FOREIGN PATENT DOCUMENTS

GB 2183076 A * 5/1987

* cited by examiner

*Primary Examiner* — Kimberly Lockett
(74) *Attorney, Agent, or Firm* — Botkin & Hall, LLP

(57) ABSTRACT

An electric spoon for being played as a musical instrument. The spoon has a head and an elongate handle. A sensor is mounted to the spoon for sensing vibrations transmitted through the handle when the spoon is struck. The sensor emits an electrical signal in response to the vibrations. The signals are used by an amplifier that may be connected to the spoon. Spoons can be joined together. Rivets or other mechanical fasteners may be used to keep the spoons together as a spoon set. When this is done one spoon has a sensor and the other does not, but serves to make contact with the other spoon when either is struck. The joined spoons can be used by a novice spoon player because less dexterity is required to keep the spoons in proper position when being played.

7 Claims, 3 Drawing Sheets

ELECTRIC SPOON

CROSS REFERENCE TO RELATED APPLICATIONS

This application claims the benefit of U.S. Provisional Application No. 61/267,958, filed Dec. 9, 2009, the disclosure of which is hereby incorporated by reference.

BACKGROUND OF THE INVENTION

Spoons can be played as an instrument for a unique sound that cannot be produced with other instruments, but are often not played with other instruments in a band. A major reason spoons are not used as accompaniment is that they are typically overshadowed by louder instruments which would completely obscure the spoon player. Instruments such as electric guitars and drums can easily drown out spoons. Presently, there is not an available solution to this problem as there is no system which amplifies the sound of the spoons to a level that can blend with other instruments. Having spoons with an amplified sound is a desirable feature that would likely make spoons an instrument more often used in a band.

SUMMARY OF THE INVENTION

The present invention is an electric spoon for being played as a musical instrument. The spoon has a head and an elongate handle. A sensor is mounted to the spoon for sensing vibrations transmitted through the handle when the spoon is struck. The sensor emits an electrical signal in response to the vibrations. The signals are used by an amplifier that can be connected to the spoon.

In another aspect of the invention, two spoons may be joined together. In this case, rivets or other mechanical fasteners can be used to keep the spoons together as a spoon set. Only one spoon needs to have a sensor. When either spoon of the spoon set is struck, the spoons will contact.

DETAILED DESCRIPTION OF THE PREFERRED EMBODIMENT

Figure 1:
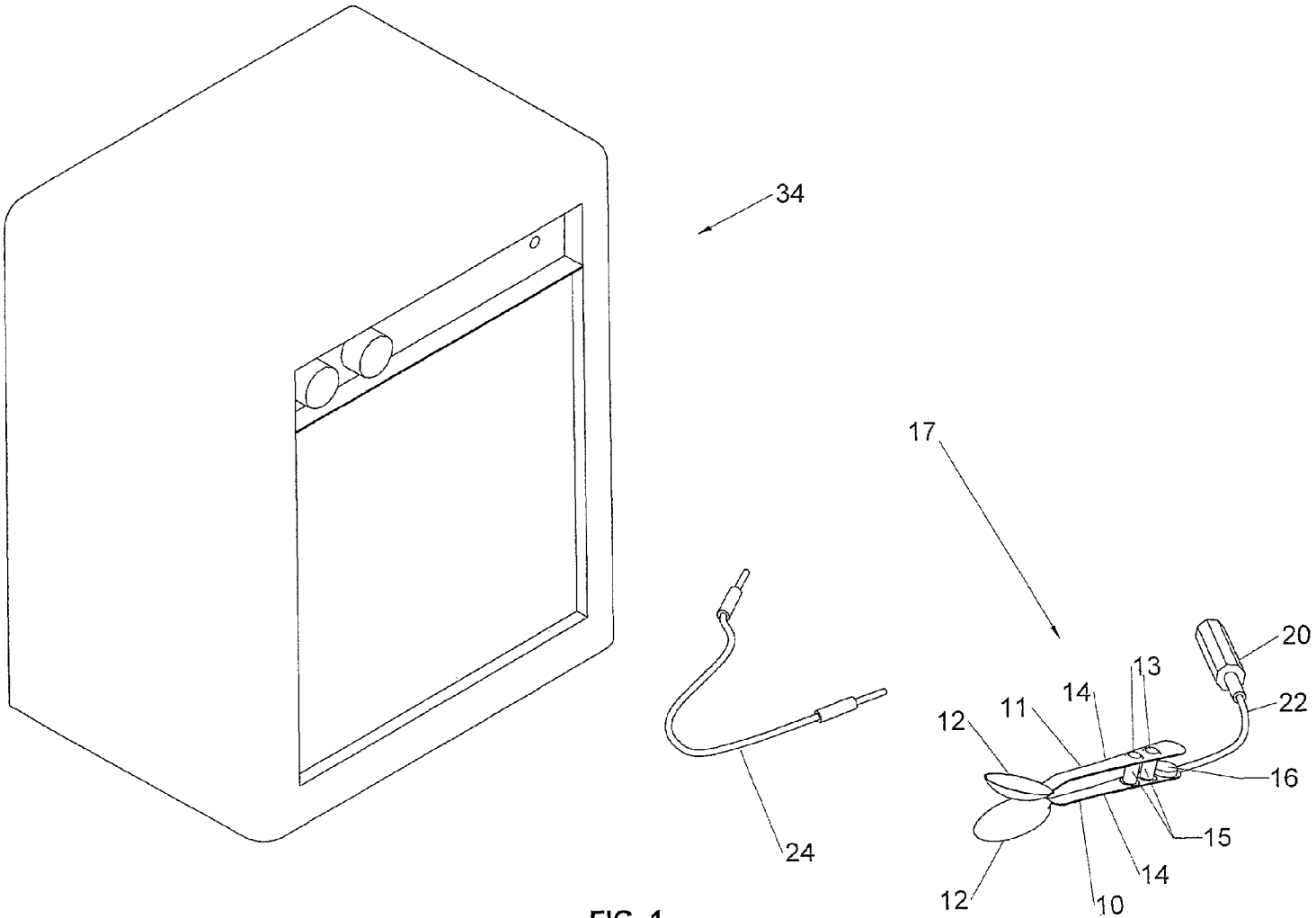
FIG. 1 shows an amplifier connecting plugs and the spoons.
Figure 2:
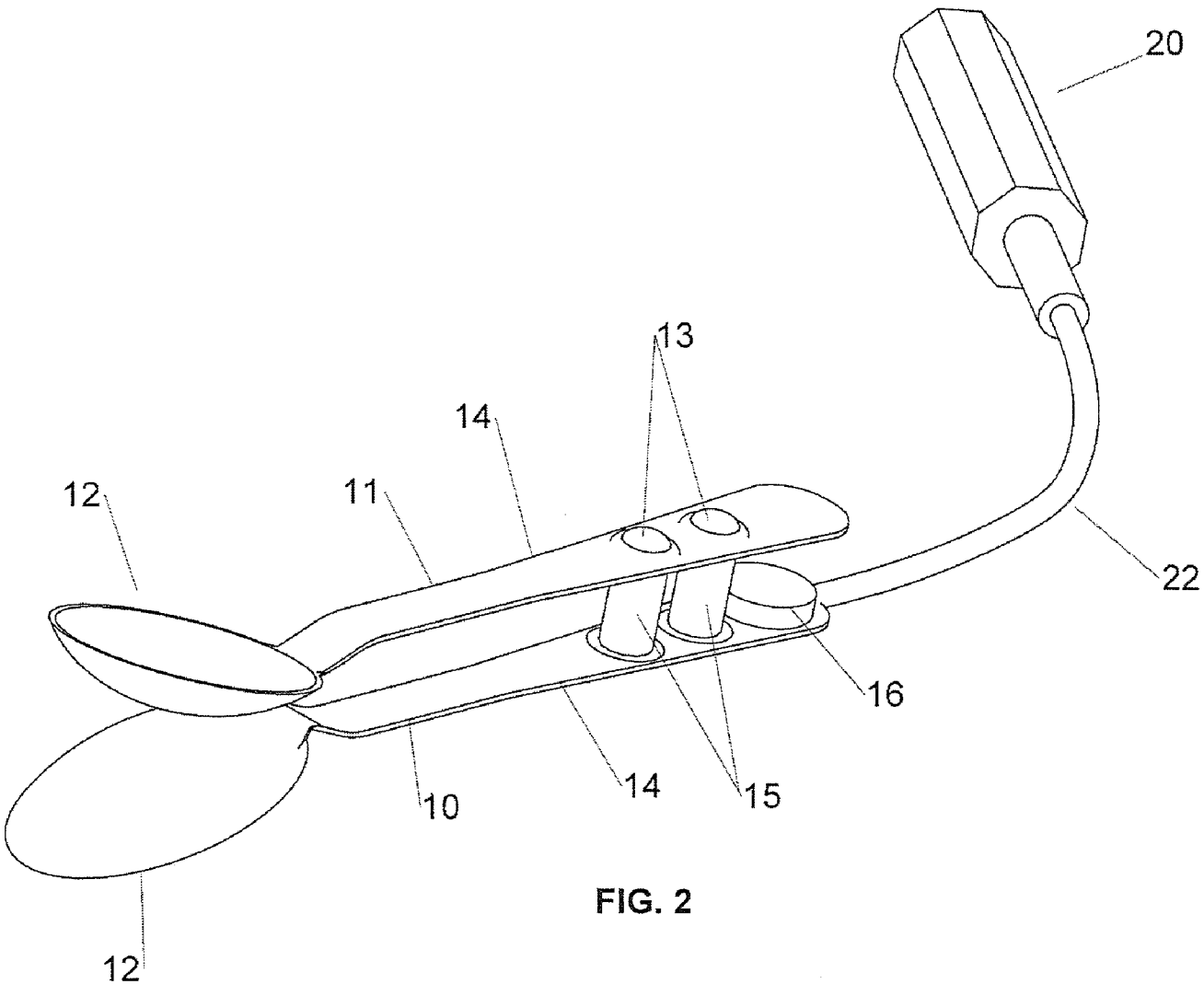
FIG. 2 shows a larger, more detailed view, of the of the spoons shown in FIG. 1.

The present invention is an electric spoon 10 which produces a much louder sound than conventional acoustic spoons. The electric spoon 10 of the present invention has a spoon 11 including a dished head 12 and a handle 14. The handle 14 will vibrate when the head 12 is struck. A sensor 16 is attached to the end of the handle 14 opposite the head 12. The sensor 16 is a drum trigger that emits a signal when it is caused to vibrate. The drum trigger 16 has a standard plug 20 on a short cord 22 that is typically used with coaxial instrument cables of the type used with electric guitars and amplifiers. The short cord 22 may then be used with an extension cord 24 so that the drum trigger 16 may be plugged into another device. The drum trigger 16 is attached to the spoon 10 with adhesive tape 30, glue, or may be attached with heat shrink tubing. The drum trigger 16 is typically a piezoelectric transducer, but may be any other type of device capable of emitting a signal in response to sonic vibration.

The extension cord 24 can be plugged into an amplifier 34. The amplifier 34 receives signals from the drum trigger 16 and amplifies them. The amplified signals are then sent to an internal speaker within the amplifier 34 so the amplified signals are converted to audible sound.

Figure 3:
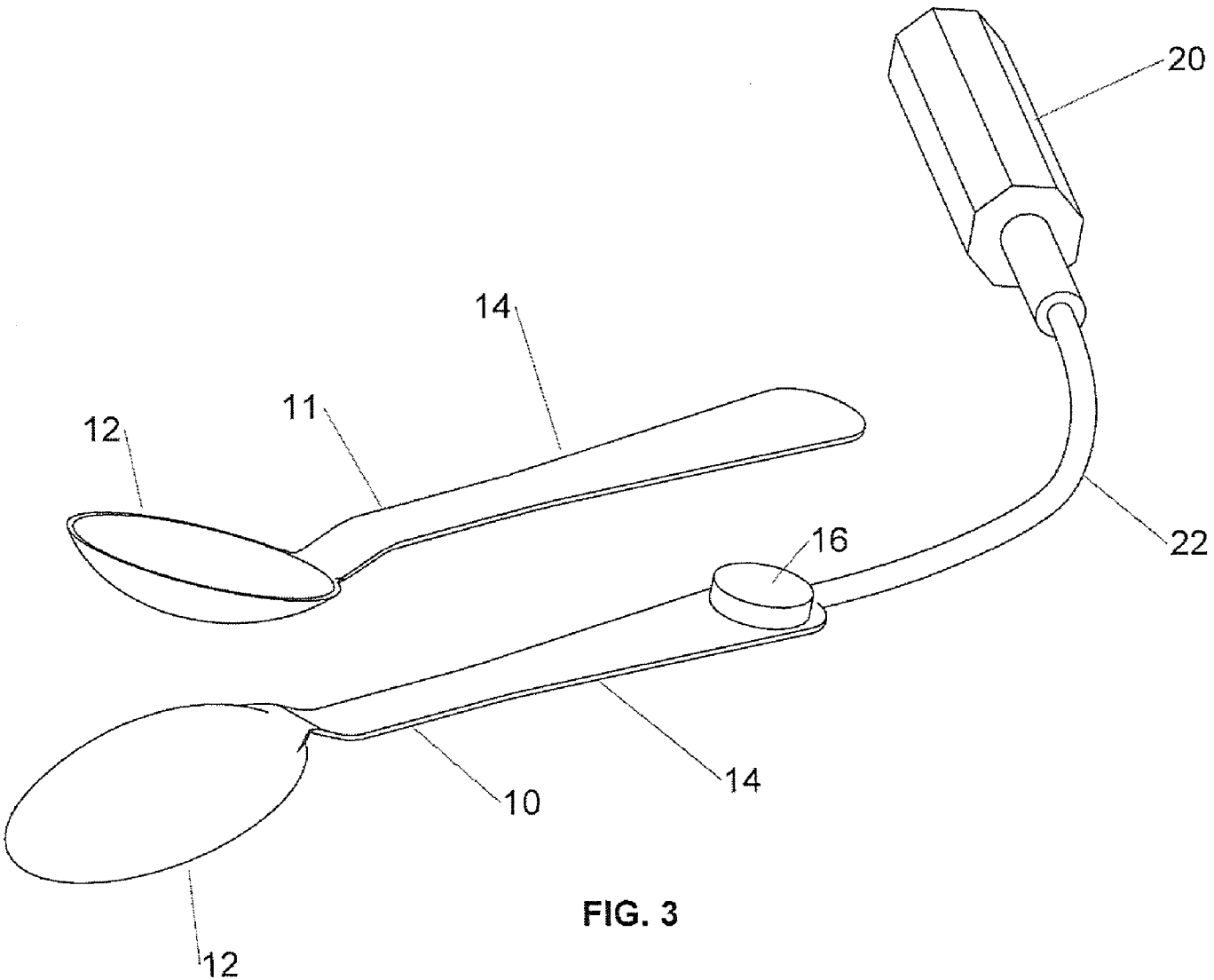
FIG. 3 shows spoons that are unattached to each other.

When a user of the electric spoon 10 plays the spoon, he will have another matching spoon 11 held closely to the electric spoon 10 and the spoons 10, 11 are struck together. In FIG. 1 rivets 13 hold the spoons 10, 11 together to form a spoon set 17. Spacers 15, which are tubular segments, are placed around the rivets to maintain a slight spacing between the heads 12 of the spoons 10, 11. The spoons 10, 11 are close enough together that the handles 14 will flex allowing the heads 12 to touch when either spoon 10, 11 is struck. This embodiment requires less dexterity as a user will not have to use a finger to keep the spoons separate during play. In the embodiment shown in FIG. 3, the user must use a finger to keep the spoons separate during play. In either embodiment, when the spoons 10, 11 are struck together, which is often done on a knee, vibrations will travel from the heads 12 up the handles 14 of the spoons 10, 11. The vibrations in the spoons 10, 11 will be audible. The vibrations will also be received at the drum trigger 16. The drum trigger 16 will generate a signal in response to the sonic vibrations traveling within the electric spoon 10 and send the signal to the amplifier 34. The amplifier 34 will then amplify the signal and send the amplified signal to a speaker. The speaker within the amplifier 34 produces a sound that can be heard. The amplifier 34 is the same type of amplifier that can be used with electric guitars and therefore, minimizes the equipment that a musician would need to play the electric spoon 10 of this invention since such amplifiers are readily available.

This invention is not limited to the details above, but may be modified within the scope of the following claims.

What is claimed is:

1. An electric spoon set comprising:

a pair of spoons each having a head and an elongate handle, said spoons being mounted oppositely to each other with said heads being spaced so that striking either spoon with sufficient force will cause said spoons to flex and contact each other; and a sensor mounted to one of said spoons for sensing vibrations transmitted through said handle when said spoon is struck said sensor emitting electrical signals in response to said vibrations said signals from said sensor being useable by an amplifier electrically connected to said sensor.

2. An electric spoon set as claimed in claim 1, wherein said spoons are fastened with a mechanical fastener extending through both said handles of said spoons.

3. An electric spoon set as claimed in claim 2, wherein said mechanical fastener is a rivet.

4. An electric spoon set as claimed in claim 3, wherein said spoon includes a tubular spacer surrounding said rivet to maintain spacing between said spoons.

5. An electric spoon set as claimed in claim 2, wherein said spoons are fastened together with a pair of mechanical fasteners, each said fastener extending through both handles of said spoons.

6. An electric spoon set as claimed in claim 5, wherein said mechanical fasteners are rivets.

7. An electric spoon set as claimed in claim 6, wherein said rivets are surrounded by a tubular spacer to maintain spacing between said spoons.

* * * * *